United States Patent [19]

Timmerman

[11] 4,164,976

[45] Aug. 21, 1979

[54] DAMPER ASSEMBLY

[75] Inventor: Walter C. Timmerman, Houston, Tex.

[73] Assignee: Timmerman Engineers, Inc., Houston, Tex.

[21] Appl. No.: 759,920

[22] Filed: Jan. 17, 1977

Related U.S. Application Data

[63] Continuation-in-part of Ser. No. 519,349, Oct. 30, 1974, abandoned.

[51] Int. Cl.[2] ..... F28F 27/02; F28F 9/26; F24F 13/14

[52] U.S. Cl. ..... 165/101; 137/601; 165/76; 165/103

[58] Field of Search ..... 137/269, 599, 601; 98/121 A; 165/76, 101, 103

[56] References Cited

U.S. PATENT DOCUMENTS

| | | | |
|---|---|---|---|
| 2,029,153 | 1/1936 | Burner | 98/121 A |
| 3,522,841 | 8/1970 | Papalexiou | 137/601 |
| 3,635,245 | 1/1972 | Canfield | 165/103 |
| 3,717,080 | 2/1973 | Foty | 98/121 A |
| 3,759,056 | 9/1973 | Graber | 98/121 A |
| 3,783,768 | 1/1974 | Caming et al. | 98/121 A |
| 3,908,528 | 9/1975 | Bertin et al. | 98/121 A |
| 3,911,953 | 10/1975 | Crombie et al. | 165/103 |

FOREIGN PATENT DOCUMENTS

| | | | |
|---|---|---|---|
| 611360 | 10/1960 | Italy | 165/103 |

*Primary Examiner*—Sheldon Jay Richter
*Attorney, Agent, or Firm*—Pravel, Gambrell, Hewitt, Kirk, Kimball & Dodge

[57] ABSTRACT

A damper assembly adapted to be affixed to an air-handling unit at an installation site including a plurality of adjacent damper assembly units adapted to be mounted with and for regulating air flow from the air-handling unit, the damper assembly unit having an interlocking structure for interlocking adjacent damper assembly units theretogether. Further, the damper assembly has a damper structure for simultaneously and independently controlling the relative mixing proportions of heated air and cooled air with ambient air for use with a multi-zone air-handling unit.

15 Claims, 13 Drawing Figures

DAMPER ASSEMBLY

CROSS REFERENCES TO RELATED APPLICATIONS

This application is a continuation-in-part of "Damper Assembly," Ser. No. 519,349, filed Oct. 30, 1974 now abandoned.

BACKGROUND OF THE INVENTION

The field of this invention is damper assemblies adapted to be used in conjunction with air-handling units.

In the design and installation of air-handling units, typically, each air-handling unit must be manufactured specifically for each individual application. This is a result of a large number of design parameters and variables encountered in terms of providing properly treated air to various parts of a structure. Ordinarily, different temperatures of treated air are required in various parts of a building structure due to such variable thermal sources such as sunlight-window exposure, poor insulation, outside access doors, or the like. As such, each unit in the past has had to be specifically designed with a particular damper arrangement design to provide the proper capacity to each individual area to be cooled, ventilated and/or heated. After the air-handling unit is built at the manufacturing site according to design plans, the air-handling unit is thereafter shipped typically to the installation site. However, should difficulties arise in providing the proper capacities of air flow to differing areas than originally contemplated, difficulty may be encountered in readjusting the capacities of treated air to be directed to the various parts of the structure to be heated, ventilated and/or cooled. So far as is known, there are currently no devices or procedures available wherein an air-handling unit can be modified easily at the installation site without requiring removal of the air-handling unit and/or major disassembly thereof. Further, duct porting arrangements typically have to be constructed at the manufacturing facility prior to installation thereof for providing for the proper routing of air discharged from the air handling unit. The addition of post-installation ports or outlets for additional ducts is difficult and/or expensive to accomplish.

Many multi-zone unis of present have a heating bank and a cooling bank wherein heated and cooled air are mixed and directed to the necessary areas requiring such heated and/or cooled air. However, this requires both the heating and cooling banks to operate simultaneously at all times which can result in the wasteful and inefficient use of energy. In attempts to eliminate this waste, devices such as those disclosed in U.S. Pat. Nos. 3,847,210; 3,508,604; and, 3,635,245 as well as Italian Pat. No. 611,360 to Gini, utilize various structures to accomplish this end. While the utilization of an ambient air zone in conjunction with heated air and cooled air zones for providing air at a proper temperature is not new within the art, the mechanisms and structure for accomplishing such vary significantly and most are complicated, expensive, difficult to manufacture and exacting devices. So far as known, none of the prior art discloses a simple, inexpensive mechanism capable of being easily assembled at the installation site of the air-handling unit and including features allowing for the simultaneous control of the mixing of cooled or heated air with ambient air.

SUMMARY OF THE INVENTION

The present invention relates to a new and improved damper assembly adapted to be affixed to an air-handling unit at an installation site having a plurality of adjacent damper assembly units adapted to be mounted with and for regulating air flow from the air-handling unit and having interlocking members with the wall sections of the unit for interlocking adjacent damper assembly units theretogether. Further, the damper assembly of the present invention has structure for simultaneously controlling the relative mixing proportions of heated air and ambient air independent of a related structure for simultaneously controlling the relative mixing proportions of cooled air and ambient air for providing the proper temperature, treated air. Still further, the damper assembly of the present invention is adapted to be mounted with a conventional air conditioning-heating unit for converting same to a more efficient, energy conserving, air-handling unit.

DESCRIPTION OF THE PREFERRED EMBODIMENT

Figure 1:
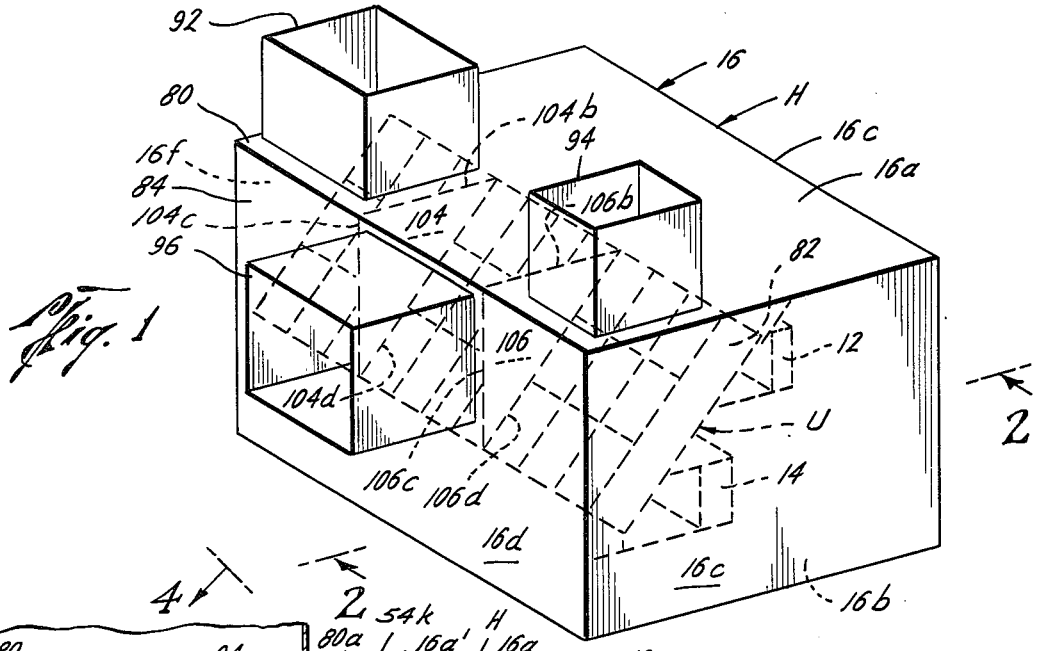
FIG. 1 is a schematic air-handling unit, schematically incorporating the damper assembly of the preferred embodiment of this invention.

Referring to the drawings, the letter A designates the damper assembly of the preferred embodiment of this invention. The damper assembly A is adapted to be mounted with an air-handling unit H and includes a plurality of damper assembly units U having interlocking means I therewith for interlocking adjacent damper assembly units U together.

Figure 13:
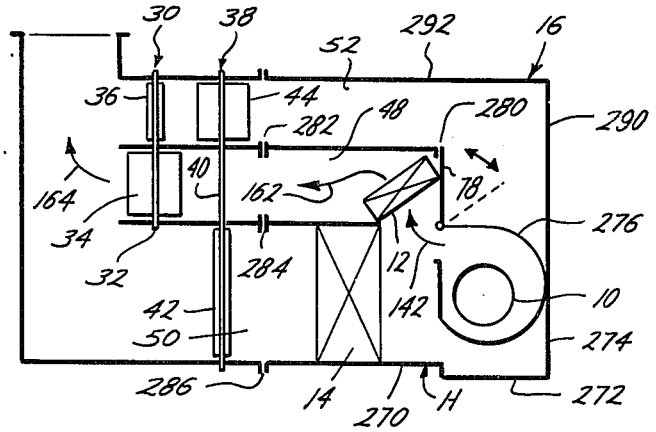

As shown schematically in FIGS. 1 and 13, the air-handling unit H includes a blower 10 of any suitable type, that directs incoming air over and through heating coils 12 and/or cooling coils 14. Generally, water, heated by boilers, is utilized to heat the heating coils 12 and, water, chilled by a cooling tower, in contradistinction, is used to cool the cooling coils 14. Methods for heating and cooling the water to be used within an air-handling unit H are well-known in the art.

The air-handling unit H includes a housing 16 having a top portion 16*a*, bottom portion 16*b*, back portion 16*c*, front portion 16*d* and side portions 16*e*, 16*f*, as shown in FIG. 1. The air-handling unit H has its heating coils 12 and cooling coils 14 mounted with housing 16 (FIG. 1, 13). Plate 16*g* is mounted with top portion 16*a*. Plate 16*j* is mounted with front portion 16*b* of housing 16 and with base 14*a* of cooling coils 14 and having plate 16*k* mounted with plate 16*j*. Plate 16*h* is mounted with the base 12*a* of the heating coils 12 and plate 16*i* is mounted with the top 14*b* of cooling coils 14. Plates 16*g*, 16*h*, 16*i*, 16*j*, 16*k* all contribute to the support and mounting of the heating coils 12, cooling coils 14 and damper assembly unit U with the air-handling unit H.

A heated air chamber 48 (FIG. 2) is formed between the heating coils 12, plate 16*h*, and the damper assembly unit U. A cooled air chamber is formed between plates 16*i*, 16*j*, cooling coils 14 and the damper assembly unit U. A neutral zone 52 is formed between the plates 16*h*, 16*i* adjacent the damper assembly unit U. The heated air chamber 48, cooled air chamber 50, and neutral zone 52 are schematically shown in FIGS. 10–13. The heated air chamber 48 is adapted to receive air forced through heating coils 12 by blower 10 and consequently heated. Similarly, cooled air chamber 50 is adapted to receive air forced through cooling coils 14 by blower 10 and consequently cooled. The neutral zone 52 is adapted to receive ambient air directed into such zone 52 by the blower 10 as discussed more fully hereinbelow.

Figure 2:
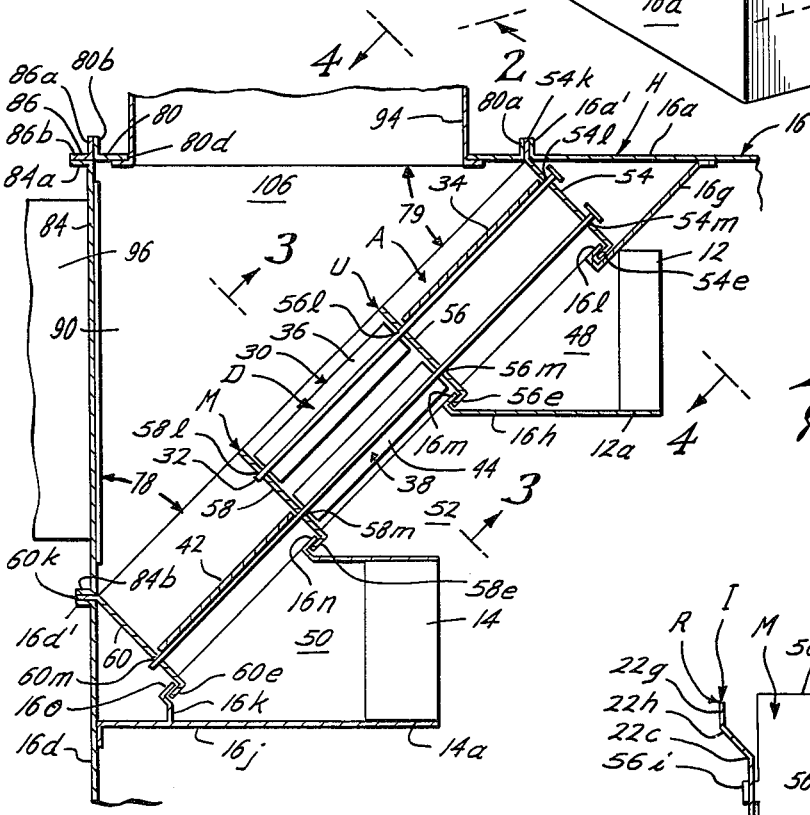
FIG. 2 is an elevational view, partly in section, showing the damper assembly of the present invention as affixed with an air-handling unit and taken along the lines 2—2 of FIG. 1.
Figure 3:
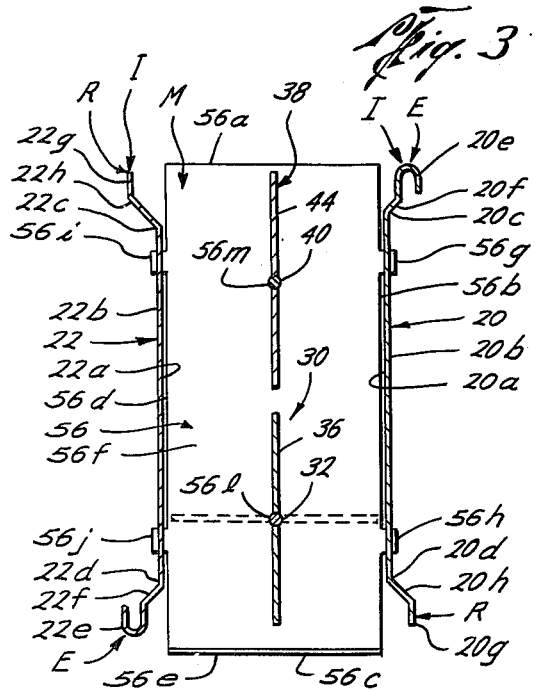
FIG. 3 is a plan view of a damper assembly unit of the present invention, taken along the lines 3—3 of FIG. 2.
Figure 5:
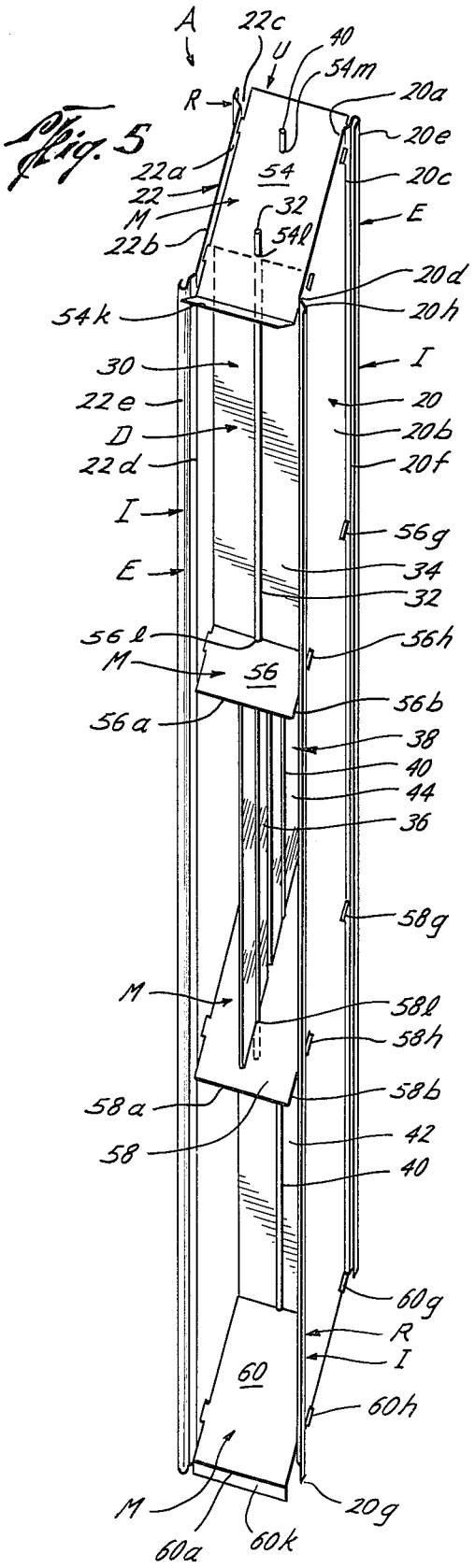
FIG. 5 is an isometric view of a damper assembly unit of the present invention, for use with a multi-zone air-handling unit.

The damper assembly A of the present invention is adapted to be affixed to the air-handling unit H. The damper assembly A includes a plurality of adjacent damper assembly units U adapted to be mounted with and for regulating air flow from the air-handling unit H. As shown in FIGS. 2 and 5, the damper assembly unit U has a first wall section 20 and a second wall section 22. The first wall section 20 and second wall section 22 have interlocking means I therewith for interlocking adjacent wall sections 20, 22 of adjacent damper assembly units U. As shown in FIG. 3, the wall sections 20, 22 have substantially flat, central inner and outer wall surfaces 20*a*, 20*b*, 22*a*, 22*b*, respectively. The wall sections 20, 22 each have a first longitudinal end portion 20*c*, 22*c* and a second longitudinal end portion 20*d*, 22*d*, respectively. Preferably, the interlocking means I is formed with the wall sections 20, 22 along their respective longitudinal end portions 20*c*, 20*d*, 22*c*, 22*d*.

The interlocking means I preferably includes engaging means E and receiving means R. Preferably, the engaging means E is formed along the first longitudinal end portion 20*c* of the first wall section 20 and also formed along the second longitudinal end portion 22*d* of the second wall section 22. The receiving means R is preferably formed along the second longitudinal end portion 20*d* of the first wall section 20 and also formed along the first longitudinal end portion 22*c* of the second wall section 22. The engaging means E preferably engages and receives the receiving means R of adjacent wall sections 20, 22 of adjacent damper assembly units U for interlocking the damper assembly units U together.

As shown in FIG. 3, the engaging means E is formed having a looped end 20*e* with the first wall section 20 and a looped end 22*e* with the second wall section 22. The looped ends 20*e*, 22*e* are formed with their respective wall sections 20, 22 adjacent offsets 20*f*, 22*f*, respectively, and preferably are of a U-configuration. The receiving means R includes ear 20*g* formed with first wall section 20 and ear 22*g* formed with second wall section 22. Ears 20*g*, 22*g* are preferably aligned with the interior portion of the looped ends 20*e*, 22*e*, both of which are substantially parallel to their respective wall sections 20, 22 and are attached thereto by their respective offsets 20*h*, 20*f*, 22*h*, 22*f*. The wall sections 20, 22 of FIG. 3 may be formed of conventional sheet metal or any other suitable material.

The damper assembly units U of the present invention further include damper means D adapted to be disposed between the first wall section 20 and the second wall section 22 for regulating air flow exiting the air-handling unit H. The damper means D includes a first damper means designated generally as 30 including a shaft 32 having preferably a first damper blade 34 and a second damper blade 36 mounted therewith. The damper means D further includes a second damper means designated generally as 38 which includes a shaft 40 having a third damper blade 42 and fourth damper blade 44 mounted therewith. The damper blades 34, 36, 42, 44 of the damper means D are preferably of conventional design and are for regulating air flow through the damper assembly unit U.

Preferably, the first damper means 30 is mounted with the air-handling unit H such that the first damper blade 34 is mounted adjacent the heated air chamber 48 and the second damper blade 36 is mounted adjacent the neutral zone 52. Preferably, the second damper means 30 is mounted with the air-handling unit H such that the third damper blade 42 and fourth damper blade 44 are mounted adjacent the cooled air chamber 50 and neutral zone 52, respectively.

The damper assembly unit U further includes mounting means M for mounting the first wall section 20 in a fixed spatial relation with respect to the second wall section 22. The mounting means M also is for mounting the damper means D between the first wall section 20 and the second wall section 22. The mounting means M includes at least two partition plates 54, 56 for positioning the first wall section 20 substantially parallel with the second wall section 22 with the partition plates 54, 56 being positioned between the wall sections 20, 22 of the damper assembly unit U for mounting the damper means D with the damper assembly unit U. Preferably, additional partition plates 58, 60 may be utilized such that the damper assembly unit U has a number of partition plates that exceeds the number of air zones to be handled by the air-handling unit H by one. Specifically as shown in FIG. 2, four partition plates 54, 56, 58, 60 are utilized for a three-zone air-handling unit H with the number of partition plates (4) exceeding the number of air zones (3 zones 48, 50, 52) that are to be handled by the air-handling unit H by one.

As shown in FIG. 3, partition plate 56 is preferably of a generally rectangular configuration having edges 56*a*, 56*b*, 56*c*, 56*d* about the periphery thereof. A depending lip 56*e* is formed adjacent edge 56*c*, preferably perpendicular to surface 56*f*. Tabs 56*g*, 56*h* are preferably formed with edge 56*b* and tabs 56*i*, 56*j* are formed with edge 56*d*. Preferably, partition plate 56 is formed of sheet metal, but alternatively, any other suitable material may be used. Partition plate 58 is similarly formed having edges 58*a*–58*d*, with a depending lip 58*e* depending from edge 58*c* and substantially perpendicular thereto, having a surface 58*f* and further including tabs 58*g*, 58*h* formed with edge 58*b* and tabs 58*i*, 58*j* formed with edge 58*d*. Partition plates 54, 60 are formed similarly as partition plates 56, 58 with similar numbers depicting similar component parts thereof (See FIGS. 2, 5). However, partition plate 54 has a mounting lip 54*k* as does partition plate 60, having mounting lip 60*k*, as described more fully hereinbelow. Preferably, mounting lips 54*k*, 60*k* are disposed preferably substantially 45° above/below, respectively, of the partition plate surfaces 54*f*, 60*f*, respectively. Openings such as openings 56*l*, 56*m* (FIG. 3) are formed in the partition plates, such as partition plate 56, for receiving shafts 32, 40, respectively.

In the assembly of the damper assembly unit U of the present invention, the damper means D is positioned between the mounting means M with the mounting means being secured to wall sections 20, 22. More specifically, the shaft 32 is inserted through opening 54*l*, having damper blade 34 thereafter attached thereto with the remaining portion of shaft 32 thereafter being inserted through opening 56*l* in mounting plate 56. Thereafter, damper blade 36 is attached to shaft 32 with the end portion of shaft 32 extending through opening 58*l* formed in partition plate 58. Similarly, shaft 40 is inserted through openings 54*m*, 56*m*, thereafter having damper blade 44 attached thereto. The remaining portion of the shaft 40 is thereafter inserted through opening 58*m*, having damper blade 43 thereafter attached thereto. The remaining portion of shaft 40 is inserted through opening 60*m* formed in partition plate 60. Thereafter, tabs such as tabs 56*g*–56*j* (FIG. 3) are inserted into appropriate slots (not numbered) formed in the first wall section 20 and second wall section 22 and appropriately secured in such slots by any suitable means, such as distorting, bending, folding, brazing, welding, or in any other manner securing the tabs in such slots. Thus, an entire damper assembly unit U is constructed having the damper means D including the first damper means 30 and second damper means 38 mounted therewith.

It will be appreciated that the damper assembly unit U of the present invention need not be of nor limited to usage with a multi-zone air-handling unit H. Other types and varieties of units may be serviced by such a damper assembly unit U. More specifically, as shown in FIG. 5, the damper assembly unit U may be used for a single-zone air-handling unit H if the damper assembly unit U were limited to that structure between partition plates 54 and 56 with wall sections 20, 22 extending therebetween. Alternatively, rather than including multiple damper means D such as first and second damper means 30, 38, the damper assembly unit U may include only a single damper means D such as that disposed between partition plates 58, 60, and including the relevant portions of the wall sections 20, 22 adjacent thereto, resulting in a damper assembly unit having only a single damper blade arrangement therein. Similarly, the damper assembly unit U may be used for a dual zone air-handling unit H by utilizing that structure therebetween partition plates 54, 58 or that between 60, 56, depending upon particular needs and design criteria involved. However, it is preferred that the damper assembly unit U be utilized in a multi-zone air-handling unit H designed for three specific types of air to be handled, namely, the heated air chamber 48 being provided with heated air forced through heating coils 12, the cooled air chamber 50 provided with cooled air forced through cooling coils 14, and the neutral zone 52 for regulating ambient air for mixing with either heated air, cooled air or providing non-treated air solely.

Figure 4:
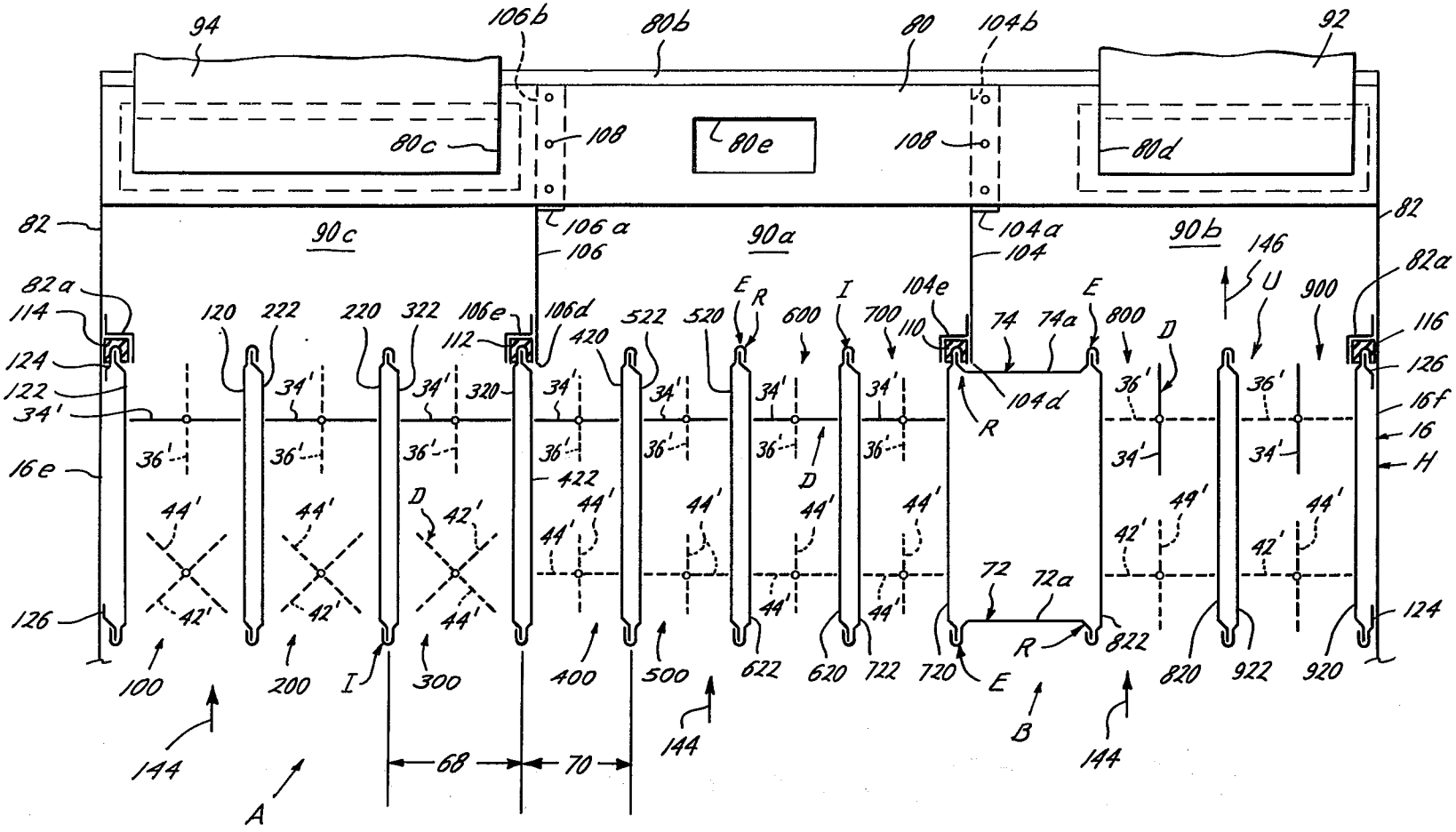
FIG. 4 is a plan view of the damper assembly units of the present invention as assembled and mounted with an air-handling unit, taken along the lines 4—4 of FIG. 2.

As shown in FIG. 4, the damper assembly units U are adapted to be positioned adjacent one another such that each of the damper assembly units U has its first wall section 20 adjacent the second wall section 22 of an adjacent damper assembly unit U. For ease in referencing, as shown in FIG. 4, the wall sections 20, 22 of each of the damper assembly units U are numbered, from left to right, 122, 120, 222, 220, 322, 320, 422, 420, 522, 520, 622, 620, 722, 720, 822, 820, 922, 920 to indicate the wall sections of first assembly unit 100, second assembly unit 200, third assembly unit 300, fourth assembly unit 400, fifth assembly unit 500, sixth assembly unit 600, seventh assembly unit 700, eighth assembly unit 800 and ninth assembly unit 900, respectively. The assembly units are adapted to be interlocked with one another with their respective interlocking means I. In such a fashion, the first assembly unit 100 is interlocked with second assembly unit 200 with the first wall section 120 of the first assembly unit 100 interlocking and engaging the second wall section 222 of the second assembly unit 200. As more clearly shown in FIG. 3, the offsets 20*f*, 20*h*, 22*f*, 22*h*, provide the necessary offset clearance for tabs, such as tabs 56*g*–56*i* of adjoining damper assembly units U, such as units 100, 200, upon interlocked assembly thereof. Similarly, the first wall section 220 of assembly unit 200 is interlocked with the second wall section 322 of the third assembly unit 300. Assembly units 400, 500, 600, and 700 are similarly interlocked with one another such that adjacent first and second wall sections of adjacent assembly units are interlocked by their respective interlocking means formed therewith. Assembly units 800 and 900 are similarly interlocked.

By varying the planar width of the partition plates such as the distance between edges 56*b* and 56*d* of partition plate 56 (FIG. 3), the overall width of the damper assembly U of the present invention may be altered. As shown in FIG. 4, the third assembly unit 300 has a width designated 68 that is greater than the width designated 70 of the fourth assembly unit 400, allowing overall flexibility in the width of the damper assembly U. Of course, the associated damper blades must be appropriately expanded and/or contracted to conform substantially to the width of the partition plate.

As the damper assembly units U are interlocked with one another adjacent their respective wall sections, it is not imperative that only damper assembly units U be used to form a contiguous damper assembly A. Blocking means B may be used to complete the damper assembly A. The blocking means B includes a first blocking member 72 and a second blocking member 74. Preferably, the blocking members 72, 74 include blocking wall sections 72*a*, 74*a* of substantially the same overall length as the wall sections 20, 22 (FIG. 5) of a damper assembly unit U. Preferably, the blocking wall sections 72*a*, 74*a* of blocking members 72, 74 are formed having interlocking means I such as engaging means E and receiving means R formed therewith. The receiving means R and the engaging means E formed with the blocking members 72, 74 are substantially identical to the receiving means R and engaging means E formed with wall sections 20, 22 (FIG. 3) of the damper assembly unit U. As such, the blocking members 72, 74, in combination with the adjacent wall sections, such as wall sections 720, 822 (FIG. 4) form essentially a "box-like" unit which effectively blocks any air flow therethrough, as described more fully hereinbelow.

Figure 9:
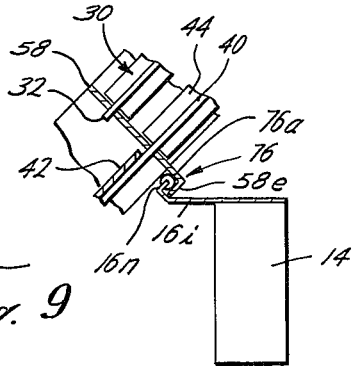
FIG. 9 is an elevational view of the sealing means disposed between the damper assembly units of the present invention and the air-handling unit to insure a sealing relation therebetween.

The damper assembly A including the multiple interlocked damper assembly units U are adapted to be mounted with the air-handling unit H. As shown in FIG. 2, the damper assembly unit U has plural depending lips such as depending lips 54*e*, 56*e*, 58*e*, 60*e* of partition plates 54, 56, 58, 60 which are adapted to engage the appropriate receiving tabs 16*l*, 16*m*, 16*n*, 16*o* formed with portions 16*g*, 16*h*, 16*i*, 16*k*, respectively. As shown in FIG. 9, preferably a suitable seal means 76 which includes seal 76*a*, preferably of a cylindrical configuration having an appropriate slot formed therein to receive the tab 16*n*, is disposed therebetween the tab 16*n* and the depending lip 58*e* to prevent fluid migration therebetween. Such seal means 76 is preferably disposed adjacent all tabs 16*l*, 16*m*, 16*n*, 16*o*.

The damper assembly units U are preferably mounted with the air-handling unit H at substantially a 45° angle designated at 78, 79 with respect to the plane of the top portion 16*a* of the housing 16 and the plane of the front portion 16*d* of the housing 16 which is discussed more fully hereinbelow. An auxiliary top 80, auxiliary side 82, and auxiliary front 84 are thereafter mounted with the damper assembly unit U and the air-handling unit H. More specifically, the auxiliary top 80 has tabs 80*a*, 80*b* formed therewith. Auxiliary side 82 has tabs 82*a*, 82*b* formed therewith and auxiliary front 84 has tabs 84*a*, 84*b* formed therewith. The mounting lip 54*k* of partition plate 54 is secured between mounting tab 16*a'* formed with the top portion 16*a* of the housing 16 and the tab 80*a* of the auxiliary top 80 by a suitable securing means (not shown) such as bolts, screws or the like. Preferably, multiple such securing means are used along the tabs 16*a'*, 80*a* for securely mounting the members together. Similarly, the mounting lip 16*k* of the partition plate 60 is secured between mounting tab 16*d'* formed with the front portion 16*d* of the housing 16 and tab 84*b* of auxiliary front 84 by appropriate securing means (not shown) such as multiple bolts, screws, or the like. Preferably, the auxiliary top 80 and auxiliary front 84 are joined with one another by an appropriate joining member 86 which is preferably of a 90° right angularly bent sheet metal. Tab 80*b* of the auxiliary top 80 is preferably secured to tab 86*a* of the joining member 86 as is tab 84*a* of the auxiliary front 84 with tab 86*b* of the joining member 86 by appropriate securing means (not shown) which may include a plurality of screws, bolts, and the like. In similar fashion, the auxiliary side 82 is joined (not shown) with the auxiliary top 80, and auxiliary front 84. Alternatively, the auxiliary side 82 may be formed with the side portions 16*e*, 16*f* of the housing 16. The auxiliary top 80, auxiliary side 82, and auxiliary front 84 as well as the damper assembly unit U define the peripheral boundaries of the exit air chamber 90. Appropriate air ducts 92, 94 are mounted with the auxiliary top 80 in appropriately formed openings 80*c*, 80*d* formed therein. Air duct 96 may be appropriately mounted with the auxiliary front 84 in a suitable opening (not numbered) formed therein. Disposition of the damper assembly units U at a substantially 45° angle (FIG. 2) with respect to the air-handling unit H allows the directing of exiting air in three potential directions, namely, up through the auxiliary top 80, out through auxiliary side 82 or through the auxiliary front 84. This provides flexibility in directing the ductwork from the air handling unit H to the remote location without necessitating multiple direction changes. Opening 80*e* of smaller dimension than openings 80*c*, 80*d* is formed with the auxiliary top 80 for the purposes of illustration and is discussed more fully hereinbelow.

The damper assembly A further includes zone separators 104, 106 (FIGS. 1, 2, 4) which are formed preferably of a general triangular configuration. Zone separator 104 has edges 104*b*, 104*c*, 104*d* and zone separator 106 similarly has edges 106*b*, 106*c*, 106*d*. Lips 104*a*, 106*a* of zone separators 104, 106 are for attaching and mounting the same with the auxiliary top 80 along edges 104*b*, 106*b* and with the auxiliary front along edges 104*c*, 106*c*, respectively, by suitable fasteners 108 such as screws, bolts and the like. Edges 104*d*, 106*d* of zone separators 104, 106 are adapted to be mounted with the damper assembly unit U adjacent the interlocking means. Preferably, a suitable mounting flange 104*e*, 106*e* is formed with the zone separators 104, 106 along edges 104*d*, 106*d*, respectively, with the mounting flanges 104*e*, 106*e* being adapted to receive suitable sealing means 110, 112 therein for suitably engaging the exterior portion of the engaging means E of the damper assembly units U adjacent thereto for preventing fluid leakage therebetween the damper assembly unit U and the zone separators 104, 106.

Mounting flanges 82*a* of auxiliary side 82 mount sealing means 114, 116 which is substantially identical to sealing means 110, 112. Sealing means 114, 116 is utilized for sealably mounting the second wall section 122 of the first assembly unit 100 with the mounting flange 82*a* of the auxiliary side 82 while sealing means 116 is used for sealably mounting the first wall section 920 of the ninth assembly unit 900 with the mounting flange 82*a* of the auxiliary side 82. Engaging tabs 124 formed similar to the engaging means E and receiving tabs 126 formed similar to the receiving means R are mounted with the side portions 16*e*, 16*f* of the housing 16 for receivably mounting wall sections 122, 920 therewith.

Figure 10:
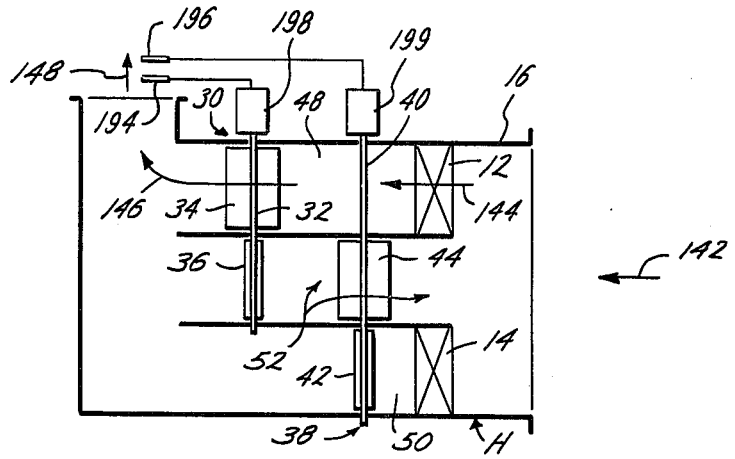
FIG. 10 is a schematic of the damper assembly of the present invention in a heating mode.
Figure 11:
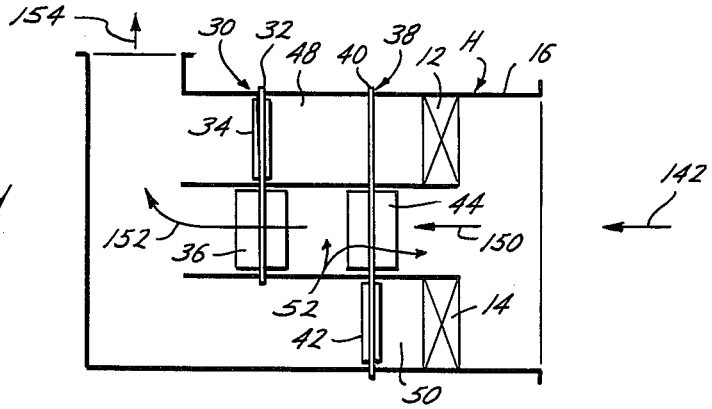
FIG. 11 is a schematic of the damper assembly of the present invention in a neutral, by-pass mode.
Figure 12:
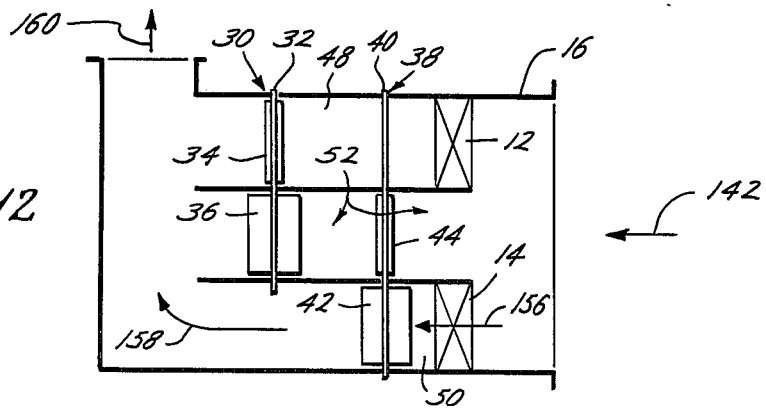
FIG. 12 is a schematic of the damper assembly of the present invention in a cooling mode; and, FIG. 13 is a schematic of the damper assembly of the present invention as preferably attached to an existing heating-cooling air-handling unit.

In the use or operation of the form of the invention illustrated in FIGS. 10–12, the damper assembly A is operational in three primary modes.

FIG. 10 schematically depicts the damper assembly A of the present invention as used in a heating mode. Incoming ambient air in the direction of arrow 142 (directed by blower 10) enters the damper assembly A. Third damper blade 42, in the closed position of FIG. 10, prevents air from flowing through the cooling coils 14 and cooled air chamber 50 to exit outwardly therefrom the housing 16. Fourth damper blade 44, being attached to the shaft 40 which also mounts the third damper blade 42, is in an open position allowing incoming ambient air 142 to flow thereacross the damper blade 44, inasmuch as the damper blades 42, 44 are disposed at 90° with respect to one another. Incoming ambient air 142 flowing across fourth damper blade 44, however, is blocked by second damper blade 36, which is in a closed position. First damper blade 34, being disposed at substantially 90° with respect to second damper blade 36, however, is in an open position. Thus, incoming ambient air in the direction of arrow 142 is unable to flow through the cooled air chamber 50 and the neutral zone 52 but may flow through the heating coils 12 in the direction of arrow 144 into the heated air chamber 48 where the heated air may flow thereacross the first damper blade 34 in the direction of arrow 146 and outwardly in the direction of arrow 148 therefrom the air-handling unit H which provides heated air for such areas having a demand for the same. In the event that heated air in the direction of arrow 146 is too hot for the downstream demands, appropriate positioning and controlling devices (discussed below) for shaft 32, sensing this condition, appropriately rotate the shaft 32 such that the first damper blade 34 begins to close allowing the second damper blade 36 to open. Thus, heated air from the heated air chamber 48 mixes with ambient air within the neutral zone 52 to reduce the overall average air temperature of the air exiting the damper assembly A in the direction of arrow 148. Thus, by appropriately rotating the shaft 32 in response to various downstream air temperature demands, the exiting air in the direction of arrow 148 may be controlled by the simultaneous control of relative mixing proportions of heated air and ambient air flowing through the air handling unit H. Rotation of the shaft 32 through substantially 90° changes the respective configuration of the first damper blade 34 and second damper blade 36 within the damper assembly A from that shown in FIG. 10 to that of FIG. 11.

The air flow, as depicted in FIG. 11, shows incoming ambient air 142 entering the damper assembly A. Inasmuch as the first damper blade 34 and third damper blade 42 block the flow of air from and through the heated air chamber 48 and cooled air chamber 50, respectively, ambient air 142 enters the neutral zone 52 in the direction of arrow 150, flows across fourth damper blade 44 and second damper blade 36 in the direction of arrow 152 and exits outwardly from the air-handling unit H in the direction of arrow 154. In this mode, the ambient air is not heated or cooled, but primarily allows circulation of the incoming ambient air.

With shaft 32 remaining stationary, incoming ambient air in the direction of 142 as shown in FIG. 11 is blocked from flowing through the heated air chamber 48. As shaft 40 rotates, the fourth damper blade 44 begins to close while the third damper blade 42 begins to open. This action allows a mixing of ambient air 142 and cooled air flowing over the cooling coils 14 in the direction of arrow 156 (FIG. 13) from the cooled air chamber 50 to mix therewith. Rotation of shaft 40 about its axis for substantially 90°, results in fourth damper blade 44 substantially blocking flow of incoming ambient air through the neutral zone 52 while all incoming ambient air in the direction of arrow 142 enters and flows through the cooling coils 14 into the cooled air chamber 50 and across third damper blade 42 and outwardly therefrom in the direction of arrows 158 and 160.

It will be appreciated that the axis of rotation of shafts 32, 40 may be horizontal or vertical, the only requirement being that the shaft 32 controls a damper blade or damper blades in the heated air chamber 48 simultaneously with the damper blade or damper blades within the neutral zone 52. Similarly, shaft 40 which controls damper blades disposed within the neutral zone 52 and the cooled air chamber 50 may likewise have an axis of rotation that may be horizontal or vertical with the only requirement being that preferably the blades for the cooled air chamber 50 and the neutral zone 52 being simultaneously controlled by a shaft 40.

Dampers 34, 36, 42, 44 can be more than one individual damper blade, having a series of damper blades which can be disposed within each chamber 48, 50 or zone 52. As shown in FIG. 4, for the purposes of illustration, the fourth, fifth, sixth and seventh assembly units 400, 500, 600, 700 are representative of a grouping of multiple damper assembly units U for controlling air flow of heated air 144 from the heated air chamber 48. As shown, the arrangement of the first damper blades 34' are such that heated air flow is blocked through assembly units 400, 500, 600, 700, as schematically shown in FIGS. 11 and 12. Similarly, the second damper blades 36' and fourth damper blades 44' are aligned in a configuration similar to that of FIG. 11 for assembly units 400, 500, 600, 700 allowing ambient air in the neutral zone 52, under the heated air chamber 48, to flow through and into the exit air chamber **90*a*. Thereafter, the ambient air may be directed through opening 80*e*** and into an appropriate air duct (not shown) and distributed to a remote downstream location requiring such ambient air.

While one downstream location may require ambient air which is satisfied by air flowing from exit air chamber **90*a*, another remote downstream location may require heated air which may be controlled by assembly units 800, 900, which are positioned as shown in FIG. 10. As such, assembly units 800, 900 have their respective damper means D positioned such that the first damper blade 34' allows the passage of heated air across damper blade 34' in the direction of arrow 146 while ambient air from the neutral zone 52 is blocked by damper blade 36', even though fourth damper blade 44' is open. Further, as shown in FIG. 10, third damper blade 42' is in a blocking position preventing the flow of cooled air thereinto exit air chamber 90*b*. As a result, heated air moving in the direction of arrow 146 is directed through opening 80*d*, thereinto duct 92**, to be directed to an appropriate remote downstream location.

Further, should another downstream location require cooling air, such would be controlled by assembly units 100, 200, 300. As is shown in FIG. 4, these assembly units have the first damper blade 34' in a blocking position with the second damper blade 36' in an open position as per FIGS. 11 and 12. The positioning of third damper blade 42' and fourth damper blade 44' indicates that a mixing of ambient air and cooled air is occurring with the positioning of such blades 42', 44' being substantially halfway between the positions of FIGS. 11 and 12. As such, heated air 144 is blocked from flow therethrough while ambient air 150 and cooled air 156 flows through the damper assembly unit U, mixing in exit air chamber **90*c*, to be directed through opening 80*c*, thereinto duct 94 and thereafter to the downstream location requiring such temperature air flow. Thus, plural damper assembly units U may be utilized to provide multiple downstream temperatures to multiple areas merely by providing an appropriate number of damper assembly units U and zone dividers, such as 104, 106**, having appropriate ducting to each of such areas, with each of such groupings of damper assembly units being separately controlled at such remote location.

As is evident from the description hereinabove, the damper assembly units U are adapted to be easily constructed and assembled at a job site, rather than having the limitation of being manufactured as a one-piece unit with the air-handling unit H at the manufacturing facility. Due to the ease of interchanging individual damper assembly units U as a result of the interlocking means I, various air-handling demands can be easily accommodated. For example, as shown in FIG. 4, to accommodate larger areas, the damper assembly units U such as assembly units 100, 200, 300 may be of a larger dimension, such as a width 68, to permit greater regulated air flow therethrough. Similarly, for more precise regulation of flow, damper assembly units U such as assembly units 400, 500, 600, 700 may be of smaller width 70 to allow for a more precise control of temperature regulated air flowing therethrough.

If a smaller area requires less volume of temperature-controlled air, a reduction in the number of damper assembly units U will limit the amount of air to be distributed to such remote location. For example, air flowing into exit air chamber **90*b* is regulated by assembly units 800, 900 with the blocking means B blocking off air flow where an additional damper assembly unit U could, if desired, be positioned, but due to reduced air flow requirements downstream, such is not necessary. However, should the conditions at a later time warrant decreased air flow, the blocking members 72, 74** can readily be removed with an appropriate damper assembly unit U being inserted therefor without requiring the disassembly of adjacent damper assembly units U.

Further, the blocking means B allows standardization of multiple sizes of damper assembly units U with any size deficiencies created by accommodating such standardized units being filled with appropriately sized blocking members 72, 74 for completing the entire bank of damper assembly units U for the damper assembly A of the present invention. Thus, not only does the damper assembly A of the present invention include the flexibility of being able to interchange multiple size damper assembly units U after the installation of the air-handling unit H at the job site, it also allows on-the-job assembly to properly provide for each individual downstream location requiring particular temperature regulated air capacities.

Further, downstream air temperature from the air-handling unit H may be effectively controlled by simultaneously mixing ambient air with heated and/or cooled air when such demands exist. This eliminates the need for both heating and cooling simultaneously incoming air to a desired temperature, thus resulting in substantial energy savings.

As shown in FIG. 13, the damper assembly A of the present invention is mounted with the air-handling unit H. The neutral zone 52 occupies an outside location rather than a central, interior location as shown in FIGS. 10–12. As is well known, a multi-zone air-handling unit H typically includes walls 270, 272, 274, 276, 278, and 280 having end points 282, 284, 286. As such, to incorporate the damper assembly A of the present invention with such a conventional air-handling unit H, wall 78 must be hingeably opened and/or removed or in any other suitable manner manufactured to allow opening thereof. Thereafter, walls 290, 292 can be simply mounted adjacent the multi-zone air-handling unit H forming a neutral zone 52 where none previously existed. Damper assembly A is thereafter affixed to the air-handling unit H at points 282, 284, 286 in similar fashion as to operate as described in FIGS. 10–12 hereinabove. As noted above, the neutral zone 52 incorporates damper blades 36, 44 being in line within the neutral zone 52. Each of these damper blades 36, 44 is respectively affixed to shafts 32, 40 with damper blades 34, 42 respectively mounted therewith at substantially 90° with respect thereto. As shown in FIG. 13, the multi-zone air-handling unit H is in a heating mode. Incoming air 142 is forced from the blower 10 through heating coils 12 into the heated air chamber 48 in the direction of arrow 162 across the open damper blade 34 and outwardly therefrom in the direction of arrow 164. By appropriate rotation of the shafts 32, 40, any combination of heated, warm, neutral, cool and/or cold air may be produced as described hereinabove.

As shown in FIG. 10, suitable downstream pressure and/or temperature sensing devices such as those well-known in the art, including pneumatic devices 194, 196 may be appropriately used in conjunction with the proper control means such as relay devices and motors 198, 199 mounted with shafts 32, 40, respectively, to control the proper angle of the damper blades of the damper means D with respect to one another to produce an outlet air of proper temperature.

Figure 6:
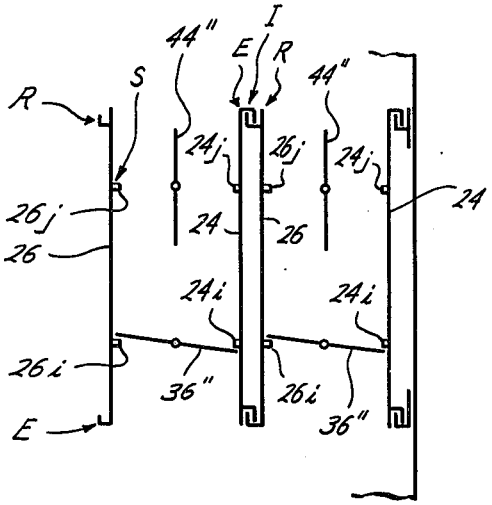
FIG. 6 is a schematic plan view of the damper assembly units of the present invention, schematically depicting an alternative embodiment of the interlocking means shown more fully in FIG. 7.
Figure 7:
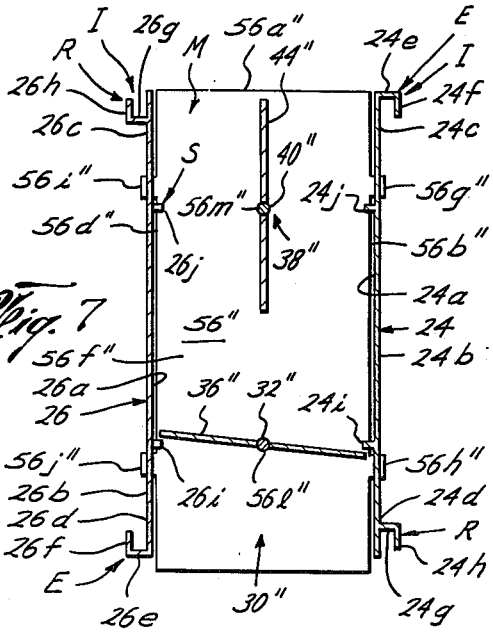
FIG. 7 is a plan view of a damper assembly unit depicting an alternative embodiment of the interlocking means of the present invention.
Figure 8:
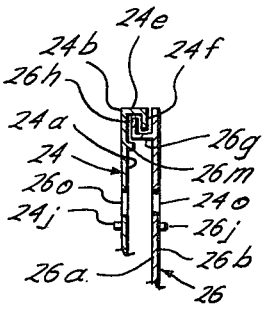
FIG. 8 is a fragmentary, sectional plan view of an alternate interlocking means, similar to that of FIG. 7, of the damper assembly unit of the present invention.

As shown in FIGS. 6–8, the damper assembly unit U may be formed having the wall sections 20, 22 formed of an extruded material, such as extruded aluminum, rather than the rolled and/or stamped sheet metal parts of the damper assembly unit U as shown in the remaining figures. FIG. 7 depicts this alternative embodiment and is similar to FIG. 3 and, for simplicity, like elements will be designated with like numbers, being followed by a double prime (″). For example, damper blade 36 of FIG. 3 is designated 36″ in FIG. 7 and so on. The mounting means M and damper means D are substantially identical with the corresponding parts of FIG. 3, with the wall sections 20, 22 (FIG. 3) being replaced with wall sections 24, 26 (FIG. 7), respectively.

As with wall sections 20, 22, wall sections 24, 26 are substantially the inverses of one another contributing to adaptability for interlocking therebetween by the interlocking means I. Wall section 24 is formed having a central inner wall surface **24*a* and a central outer wall surface 24*b*, having longitudinal end portions 24*c*, 24*d* at each end thereof. Adjacent end 24*c*, the engaging means E is formed of members 24*e*, 24*f*, with member 24*e* substantially perpendicular to outer wall surface 24*b* and extending outwardly therefrom, with member 24*f* being substantially perpendicular to member 24*e*** and extending downwardly therefrom, forming generally an inverted "L" configuration.

The receiving means R is formed adjacent longitudinal end portion **24*d* and includes members 24*g*, 24*h*, with member 24*g* being substantially perpendicular to outer wall surface 24*b* and extending therefrom at a distance displaced from the end portion of the wall section 24 with member 24*h* being substantially perpendicular to member 24*g* and extending downwardly therefrom forming an "L" configuration adapted to receive and interlock with the "L" configuration of the engaging means E. Wall section 26 is formed substantially identically with like alphabetical letters added to 26 signifying and identifying similar parts as per wall section 24**.

Stop means S may be formed with the wall sections 24, 26 for limiting rotation of the damper means D. The stop means preferably includes stop members **24*i*, 24*j*, 26*i*, 26*j* formed on the inner wall surfaces 24*a*, 26*a* of wall sections 24, 26, respectively. As shown in FIG. 7, when damper blades such as damper blade 36″ rotates to a blocking position, the ends thereof engage the stop members 24*i*, 26*i* to limit further rotation of the damper blade 36″ and further to provide an effective sealing surface for preventing fluid leakage therebetween the damper blade 36″ and the stop members 24*i*, 26*i***.

As shown in FIG. 6, the alternative configuration of the interlocking means I of FIG. 7 is adapted to allow adjacent damper assembly units U to be interlocked with member 24*f* being insertable and locatable between member 26*h*, and wall surface 26*a* while member 26*f* is insertable and locatable between member 24*h* and wall surface 24*b* of an adjacent wall sections 24, 26. Thus, in similar fashion to the interlocking means I discussed hereinabove, adjacent units may be appropriately secured to one another. This is specifically shown in FIG. 8 and further includes an additional detent 26*m* which locates the member 26*g* therebetween the member 24*f* and 26*m* such that the member 26*h* is properly aligned between members 24*f* and inner wall surface 24*a*. Suitable slots 26*o*, 24*o* are formed therein to receive tabs 56*g*'', 56*i*'' of adjacent partition plates 56'' from adjacent damper assembly units U.

Thus, the damper assembly A of the present invention, in contradistinction to the fixed, premanufactured assemblies of the prior art, allows for on-the-site installation of appropriate damper assembly units U of varying widths and multiple capacities to conform to any particular air capacity necessary. Flexibility is obtained in that after installation, should it be necessary to modify the air flow characteristics to remote areas, zone separators 104, 106 may be easily moved to desirable locations to increase-decrease the capacity of air flow to a particular remote location while additionally, damper assembly units U may be altered in accordance with any design criteria with relative ease. Further, multiple duct sizes may be mounted with the air-handling unit H because differing sized openings such as different sized openings 80*c*, 80*d*, 80*e* formed with auxiliary top 80 may be used to accommodate any downstream requirements. Such openings need not be manufactured in the auxiliary members, but to the contrary, may be appropriately sized on the job by the installer with appropriate tools (not shown) such as tin snips, saws or the like. Still further, the damper assembly A of the present invention results in an energy-saving device requiring no close tolerance, intricately timed, complicated, valving arrangements, but to the contrary, allows existing air-handling units H to be adapted to incorporate the damper assembly A of the present invention with relative ease and only minor modifications thereof.

The foregoing disclosure and description of the invention are illustrative and explanatory thereof, and various changes in the size, shape and materials as well as in the details of the illustrated construction may be made without departing from the spirit of the invention.

I claim:

1. A damper assembly adapted to be affixed to an air-handling unit at an installation site with the air handling unit being a multizone air conditioning-heating unit having a heated air chamber, a cooled air chamber, and a neutral zone for receiving ambient air, comprising:

a plurality of adjacent damper assembly units adapted to be mounted with and for regulating air flow from the air-handling unit, each of said damper assembly units having:

a first wall section;

a second wall section;

damper means adapted to be disposed between said first wall section and said second wall section for regulating air flow exiting the air-handling unit; and, mounting means for mounting said first wall section in a fixed spacial relation to said second wall section and for mounting said damper means between said first wall section and said second section wall section, said mounting means including at least two partition plates for positioning said first wall section substantially parallel with said second wall section, said partition plates being disposed between said first and second wall sections of said damper assembly unit for mounting said damper means with said damper assembly unit;

interlocking means with said wall sections for interlocking said adjacent wall sections of said adjacent damper assembly units;

said damper assembly units including a first damper means and a second damper means;

said first damper means mounted with said heated air chamber and said neutral zone for simultaneously controlling relative mixing proportions of heated air and ambient air; and, said second damper means mounted with said cooled air chamber and said neutral zone for simultaneously controlling relative mixing proportions of cooled air and ambient air, independent of said first damper means.

2. The damper assembly of claim 1, wherein:

said engaging means is of a substantially "L" configuration.

3. The damper assembly of claim 1, wherein:

said first damper means is aligned with said second damper means within said neutral zone.

4. The damper assembly of claim 1, wherein said first damper means includes:

a first damper blade with and for said heated air chamber;

a second damper blade with and for said neutral zone; and, a first shaft having said first damper blade and said second damper blade mounted therewith for simultaneous movement of said first and second damper blades.

5. The damper assembly of claim 4, wherein:

said first damper blade is disposed at substantially 90 degrees with respect to said second damper blade.

6. The damper assembly of claim 5, wherein said second damper means includes:

a third damper blade with and for said cooled air chamber;

a fourth damper blade with and for said neutral zone; and, a second shaft having said third damper blade and said fourth damper blade mounted therewith for simultaneous movement of said third and fourth damper blades.

7. The damper assembly of claim 6, wherein:

said third damper blade is disposed at substantially 90 degrees with respect to said fourth damper blade.

8. The damper assembly of claim 1, wherein said second damper means includes:

a third damper blade with and for said cooled air chamber;

a fourth damper blade with and for said neutral zone; and, a second shaft having said third damper blade and said fourth damper blade mounted therewith for simultaneous movement of said third and fourth damper blades.

9. The damper assembly of claim 8, wherein:

said third damper blade is disposed at substantially 90 degrees with respect to said fourth damper blade.

10. The damper assembly of claim 1, further including:

means for controlling said first damper means and said second damper means remote from the multi-zone air conditioning-heating unit.

11. The damper assembly of claim 10, wherein said controlling means includes:

pneumatic means for opening and closing said first and second damper means in response to temperature demands downstream of the multi-zone unit.

12. A damper assembly adapted to be affixed to an air-handling unit at an installation site, comprising:

a plurality of adjacent damper assembly units adapted to be mounted with and for regulating air flow from the air-handling unit, each of said damper assembly units having:

a first wall section;

a second wall section;

damper means adapted to be disposed between said first wall section and said second wall section for regulating air flow exiting the air-handling unit, said damper means including a first damper shaft;

a second damper shaft;

said first and second damper shafts are adapted to be mounted with said damper assembly unit in substantially parallel relation to one another, with the plane defined by the longitudinal axes of said first and second damper shafts being substantially parallel with and between said first and second wall sections;

mounting means for mounting said first wall section in a fixed spacial relation to said second wall section and for mounting said damper means between said first wall section and said second wall section, said mounting means including a plurality of partition plates including first, second, third and fourth partition plates;

said first damper shaft having a first damper blade mounted between said first and second partition plates and a second damper blade mounted between said second and third partition plates; and, said second damper shaft having a third damper blade mounted between said second and third partition plates and a fourth damper blade mounted between said third and fourth partition plates.

13. The damper assembly of claim 12, wherein:

said first damper blade is disposed along said first damper shaft at substantially 90 degrees with respect to said second damper blade; and, said third damper blade is disposed along said second damper shaft at substantially 90 degrees with respect to said fourth damper blade.

14. The damper assembly of claim 13, with the air-handling unit being a multi-zone air-conditioning-heating unit having a heated air chamber, a cooled air chamber, and a neutral zone for receiving ambient air, wherein:

said first damper blade is mounted with and for the heated air chamber;

said fourth damper blade is mounted with and for the cooled air chamber;

said second and third damper blades are mounted with and for the neutral zone;

said first damper shaft simultaneously controls the relative mixing proportions of heated air from the heated air chamber and ambient air from the neutral zone; and, said second damper shaft simultaneously controls the relative mixing proportions of cooled air from the cooled air chamber and ambient air from the neutral zone, independently of said first damper shaft.

15. A damper assembly adapted to be affixed to an air-handling unit at an installation site, comprising:

a plurality of adjacent damper assembly units adapted to be mounted with and for regulating air flow from the air-handling unit, each of said damper assembly units having:

a first wall section;

a second wall section;

damper means adapted to be disposed between said first wall section and said second wall section for regulating air flow exiting the air-handling unit; and, mounting means for mounting said first wall section in a fixed spacial relation to said second wall section and for mounting said damper means between said first wall section and said second wall section;

interlocking means with said wall sections for interlocking said adjacent wall sections of said adjacent damper assembly units; and, blocking means removably mounted with said damper assembly units for blocking air flow and for substituting for said damper assembly units where desired.

* * * * *